US008668119B2

(12) United States Patent
Wheeler

(10) Patent No.: US 8,668,119 B2
(45) Date of Patent: Mar. 11, 2014

(54) CONTAINER FOR VISCOUS COMESTIBLES

(76) Inventor: James Wheeler, Ashburn, VA (US)

( * ) Notice: Subject to any disclaimer, the term of this patent is extended or adjusted under 35 U.S.C. 154(b) by 417 days.

(21) Appl. No.: 12/873,524

(22) Filed: Sep. 1, 2010

(65) Prior Publication Data

US 2011/0049170 A1 Mar. 3, 2011

Related U.S. Application Data

(60) Provisional application No. 61/239,595, filed on Sep. 3, 2009.

(51) Int. Cl.
*B67D 7/60* (2010.01)

(52) U.S. Cl.
USPC ..... 222/386; 222/522; 222/527; 220/707; 220/708; 239/33; 239/103; 239/104

(58) Field of Classification Search
USPC ..... 222/386, 322, 321.8, 320, 222/153.05–153.06, 527, 530, 522, 525, 222/523, 562, 559, 507, 506, 503, 520, 502, 222/519, 524, 526, 182, 256, 207, 204, 222/416; 426/85, 111, 122; 239/33, 103, 239/104, 140, 195, 271, 288
See application file for complete search history.

(56) References Cited

U.S. PATENT DOCUMENTS 3,417,862 A * 12/1968 Fong ..... 206/517
4,428,498 A * 1/1984 Obey ..... 220/367.1
4,852,772 A 8/1989 Ennis, III
5,253,787 A * 10/1993 Wilkinson et al. ..... 222/209
5,356,016 A 10/1994 Wiedemann
5,361,934 A * 11/1994 Spence, Jr. ..... 220/707
5,401,254 A 3/1995 Bunce
6,196,413 B1 * 3/2001 Tung ..... 220/709
6,237,817 B1 * 5/2001 Son ..... 222/527
6,403,137 B1 * 6/2002 Frutin ..... 426/477
6,749,092 B2 * 6/2004 Olechowski et al. ..... 222/514
7,040,223 B2 5/2006 Arai et al.
7,124,907 B2 * 10/2006 Conaway ..... 220/254.1
D543,559 S * 5/2007 Wheeler ..... D15/82
7,624,899 B1 * 12/2009 Barksdale ..... 222/530
7,731,101 B2 * 6/2010 Fabrizio et al. ..... 239/33
D622,604 S 8/2010 Wheeler
7,845,489 B2 * 12/2010 Thompson ..... 206/217
2003/0102333 A1 6/2003 Wright
2007/0056996 A1 * 3/2007 Zijing et al. ..... 222/530
2007/0075102 A1 * 4/2007 Moore ..... 222/519
2010/0196556 A1 8/2010 Wheeler

* cited by examiner

*Primary Examiner* — Kevin P Shaver
*Assistant Examiner* — Michael J Melaragno
(74) *Attorney, Agent, or Firm* — Schmeiser, Olsen & Watts LLP

(57) ABSTRACT

A container for containing and dispensing viscous comestibles, such as ice cream, is disclosed. The container includes a container body with a nozzle and a container cap movably coupled to the container body. The container cap moves between at least two positions, a first position where the container cap covers the nozzle, and a second position where a portion of the nozzle extends through a container cap opening. In some embodiments a straw portion of the nozzle extends through the container cap opening. A method of containing viscous comestibles is disclosed which includes attaching a container cap to a container body such that the container cap has at least two positions, testing that the container cap moves to each of its at least two positions, inserting viscous comestibles into the container body through a nozzle opening in the container body nozzle, and locking the container cap in the first position.

9 Claims, 9 Drawing Sheets

CONTAINER FOR VISCOUS COMESTIBLES

CROSS REFERENCE TO RELATED APPLICATION

This application claims priority to U.S. Patent Application to James R. Wheeler entitled "DISPENSING DEVICE WITH STRAW," Ser. No. 61/239,595, filed Sep. 3, 2009, the disclosure of which is hereby incorporated entirely herein by reference.

BACKGROUND OF THE INVENTION

1. Technical Field

The present invention relates generally to the field of containers and more specifically relates to containers for use with viscous comestibles.

2. State of the Art

Containers and cartridges may be useful for containing various materials such as beverages and foods. Beverages and foods may be heated or cooled to preserve the desired taste, texture and over-all quality of the comestibles according to a consumer's preference. Heating comestibles may tend to decrease the viscosity of the product, thereby making it more flowable. Cooling comestibles may tend to increase the viscosity of the product, thereby making it less flowable, potentially creating problems for consuming such products.

Ice cream, a typically cooled comestible, may be purchased in large cartons, pails and scrounds from grocery markets, and in smaller quantities from retail ice cream shops, fast-food restaurants, convenience stores, and concessions. For ice cream, frozen yogurts, and other such products, ideally the temperature of the product should remain low to preserve the desired quality for a reasonable duration; however this greatly increases the viscosity of such products potentially rendering them unflowable from typical containers or cartridges.

Certain containers attempt to solve this problem by designing the container with a lid that is removed to allow the contents to be consumed, thus allowing a disposable utensil to be used by a consumer to spoon out the frozen product. The use of a spoon increases the over-all cost of serving such a product and increases waste since the majority of disposable utensils are discarded after a single use, thereby increasing demand on landfills. In addition, the use of a removable lid also allows the lid to be lost or contaminated. Use of a spoon may also not be practical should the product become less viscous. Further, this style of container is unlikely to prevent any spillage should the container be upset or oriented horizontally.

Other containers may use an oversized straw allowing an individual to consume a semi-frozen beverage by suction means. One problem with this approach is that the frozen item has varying viscosities because of variations in temperature. A user thus finds themselves looking for warmer, less viscous areas to suck from and often has to simply wait for the product to thaw more fully. Similarly, for frozen products, those with fruit or other objects or very thick viscous products, this alternative may not be feasible. Fruit and other particulates, such as toppings and the like may plug the straw and/or the thick product may not be able to be 'sucked' through even an oversized straw. Cones may also be used for serving frozen products such as ice cream; however the cone and ice cream must be consumed within a limited time frame to prevent the ice cream from melting and creating a mess. Cones may also be easily contaminated and become unsanitary should they come into contact with unclean surfaces or hands Ideally, a container system for storing and dispensing frozen and partially frozen comestibles should comprise a sanitary means to substantially contain liquids and solids at various consistencies and yet remain cost-efficient to manufacture and use. Thus, a need exists for a reliable containment system to consistently purvey frozen foods and beverages in varied environmental conditions and to avoid the above-mentioned problems.

DISCLOSURE OF THE INVENTION

The invention disclosed relates to a containment and dispensing system for use with high viscosity comestibles. The container may be used to purvey frozen and/or partially frozen comestibles such as ice-cream and frozen and/or partially frozen yogurt, custard, gelato, sorbet and other frozen or partially frozen viscous comestibles. In some embodiments other comestibles are contained such as soup, pudding, applesauce, breakfast yogurt, cheese sauce, or similar products. The container for viscous comestibles according to the invention comprises a container body with a proximal end and a distal end. A nozzle with a nozzle opening is at the proximal end of the container body. A container cap is movably coupled to the container body such that the container cap has at least two positions. The first position of the container cap is toward the proximal end, and the container cap covers the nozzle in response to the container cap being in the first position. The second position of the container cap is toward the distal end, and a portion of the nozzle extends through a container cap opening in response to the container cap being in the second position.

In some embodiments the container cap opening has a tamper-proof seal. In some embodiments the distal end moves towards the proximal end in response to dispensing the viscous comestibles through the nozzle opening. In some embodiments the nozzle has an integral straw. In some embodiments the nozzle opening is sealed with a straw cap. In some embodiments the integral straw has an extended position and a retracted position. In some embodiments the nozzle has a flexible base, wherein the flexible base folds into the container body to place the straw in the retracted position.

A container for viscous comestibles is disclosed including a proximal and a distal end. A nozzle with a nozzle opening is at the proximal end. The nozzle includes a flexible straw base coupled to the container body proximal end, a straw coupled to the flexible straw base, and a nozzle opening in the straw for dispensing the viscous comestibles.

In some embodiment the straw has a retracted position and an extended position. In some embodiments the straw is in the retracted position in response to the flexible straw base folding onto the container body. In some embodiments a lid is coupled to the flexible straw base, and the lid prevents the straw from moving to the extended position. In some embodiments the distal end moves towards the proximal end in response to dispensing the viscous comestible through the nozzle opening. In some embodiments the container includes a container cap moveably coupled to the container body. The container cap has at least two positions, a first position where the container cap covers the nozzle, and a second position where the straw extends through a container cap opening.

A method of containing viscous comestibles is disclosed which includes the step of attaching a container cap to a container body such that the container cap has at least two positions, a first position where the container cap covers a container body nozzle, and a second position where a straw portion of the container body nozzle extends through a container cap opening. The method of containing viscous comestibles also includes the steps of testing that the container cap is able to move to each of its at least two positions, inserting viscous comestibles into the container body through a nozzle opening in the container body nozzle, and locking the container cap in the first position. In some embodiments the method also includes the step of sealing the container cap with a tamper-proof seal. In some embodiments the method also includes the step of inserting a plunger cap into the distal end of the container body. In some embodiments the method includes the step of sealing the nozzle opening with a straw cap. In some embodiments the method includes the step of pulling the straw into an extended position.

The foregoing and other features and advantages of the present invention will be apparent from the following more detailed description of the particular embodiments of the invention, as illustrated in the accompanying drawings.

BRIEF DESCRIPTION OF THE DRAWINGS

FIG. 6 also shows how plunger 320 moves from distal end 114 towards proximal end 112 as viscous comestibles 120 is dispensed from nozzle opening 330.

DETAILED DESCRIPTION OF EMBODIMENTS OF THE INVENTION

Figure 1:
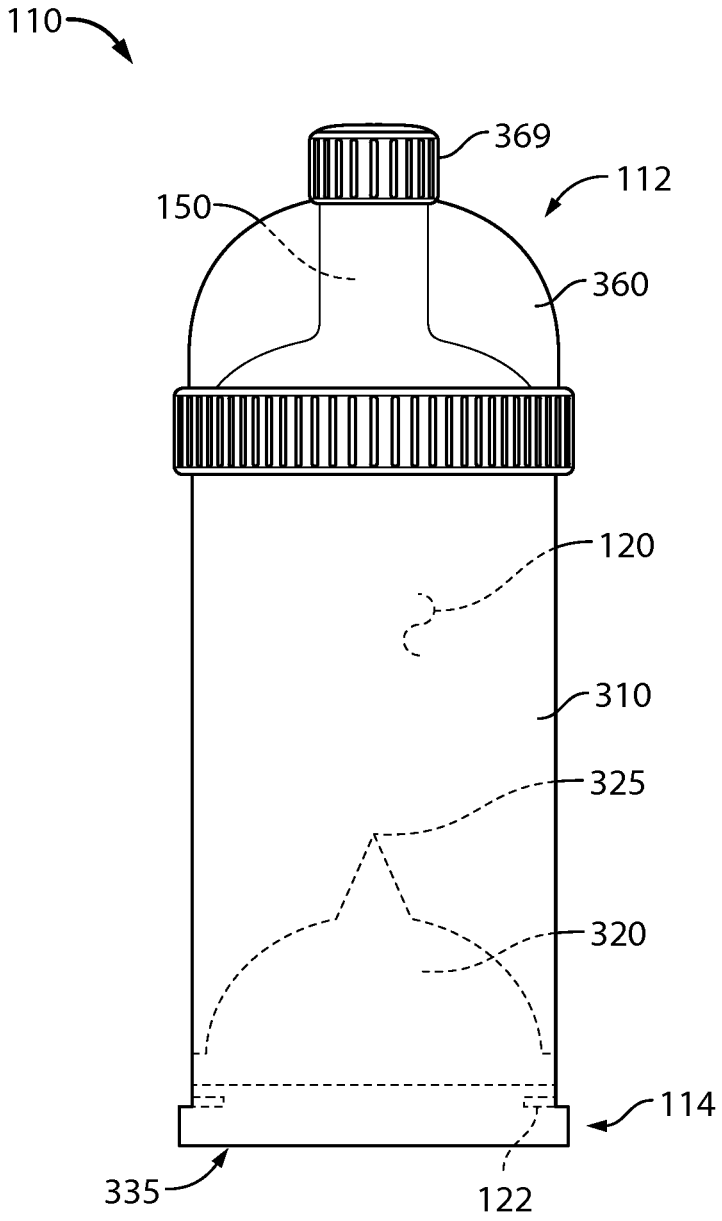
FIG. 1 is a side view of an embodiment of container 110 for viscous comestibles according to the invention with container cap 360 in a first position where container cap 360 covers nozzle 150.

As discussed above, embodiments of the invention relate to a container system for containing and dispensing viscous comestibles. Viscous comestibles typically include frozen and/or partially frozen comestibles such as ice-cream and frozen and/or partially frozen yogurt, custard, gelato, sorbet, and smoothies. Viscous comestibles can also include soup, pudding, applesauce, breakfast yogurt, and other similar products. FIG. 1 shows container 110 according to the invention for containing viscous comestibles 120.

Ice-cream is a frozen dessert preferably comprising dairy products such as milk and cream that may be preferably combined with at least one flavoring and/or at least one sweetener and optionally other ingredients. For the purposes of this application the term ice-cream includes traditional ice-cream, frozen custard, frozen yogurt, gelato, sorbet, frozen dairy desserts, smoothies, and other similar products with similar compositions which are also preferably served in a frozen or partially frozen state to provide a smoothly consistent textured product.

Products such as those described above, by nature have consistencies that may be resistant to flow since they are preferably kept in a frigid state. Resistance to flow may be measured by viscosity. Viscosity is a measure of the resistance of a fluid which is being deformed by either shear stress or extensional stress. The viscosity is the resistance of at least one liquid to flow, or its 'thickness' and is a means to measure a fluid's friction, which equates to its internal resistance to flow. For example, a liquid such as milk is 'thinner', thereby exhibiting a lower viscosity than cream, which is thicker and has a higher viscosity.

The viscosity of ice cream mixtures is affected by the composition of the mixture including the contents of moisture and stabilizers, temperature and length of storage after manufacture. Specifically, the viscosity of ice cream is pseudoplastic in nature meaning that as the sheer rate increases the viscosity decreases. The apparent viscosity also decreases with time of applied sheer stress, a phenomenon known as thixotropy.

The disclosed invention contains viscous comestibles 120 in container 110 which are a frozen and/or semi-frozen viscous comestibles maintained at about −10 degrees Fahrenheit (F) to about +25 degrees F. Viscous comestibles 120 maintained at about −10 degrees to +25 degrees F. may be consumed from container 110 without delay in its viscous state, without waiting for the product to soften from the effects of ambient temperature, friction or another artificial heat source. Viscous comestibles 120 can be ice cream, for example. Alternatively, the product can be heated by any suitable method to reduce the viscosity and provide a more flowable result. In some embodiments, the disclosed invention includes viscous comestibles 120 with a viscosity in the range of about 0 to 250,000 centiPoise (cP).

Figure 2:
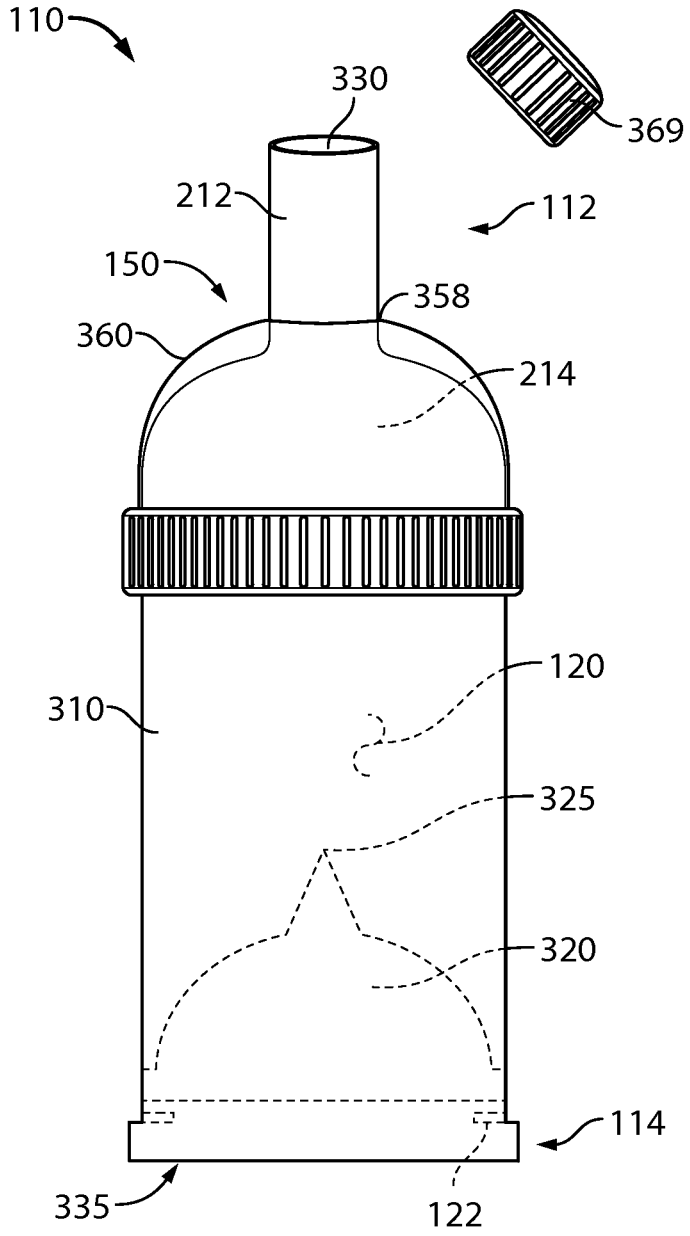
FIG. 2 is a side view of container 110 of FIG. 1 with container cap 360 in a second position where a portion of nozzle 150 is exposed.
Figure 3:
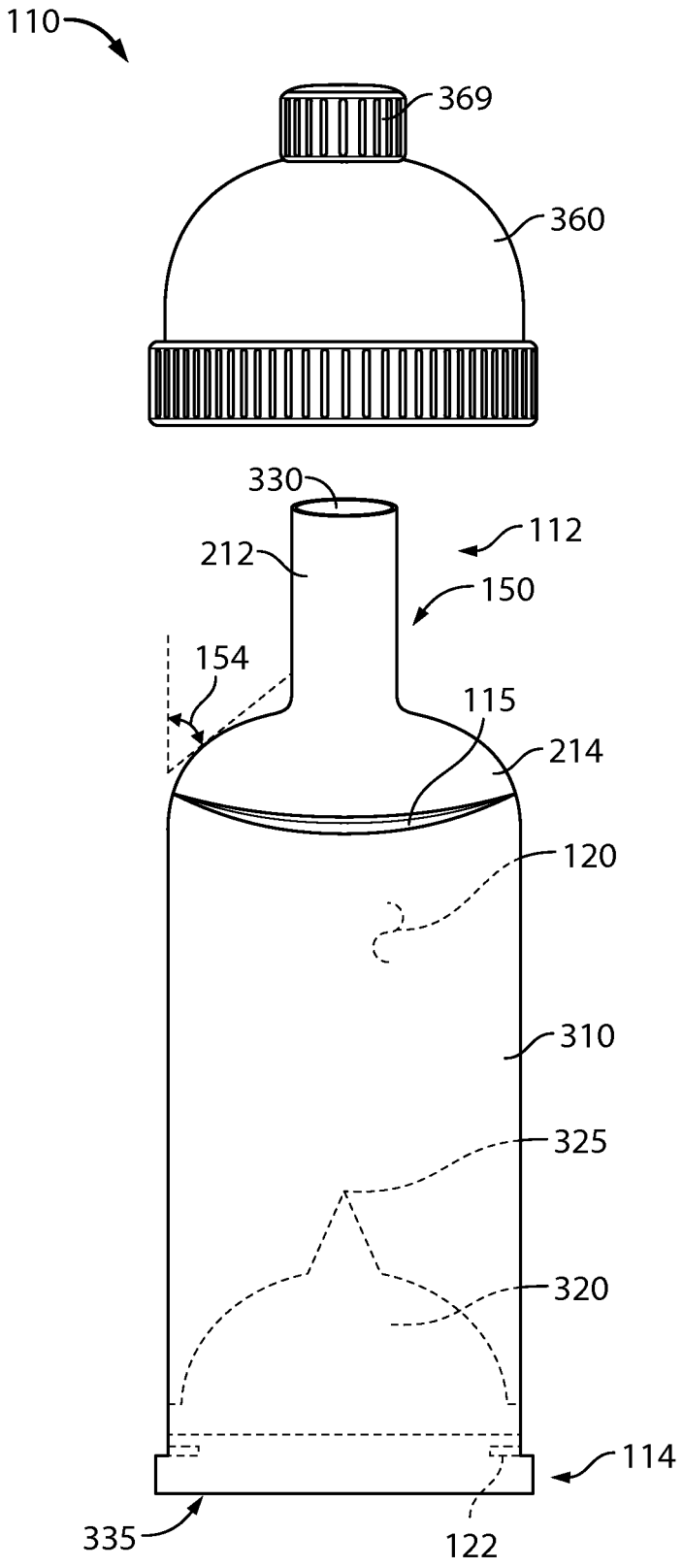
FIG. 3 shows a side view of container 110 of FIG. 1 where container cap 360 has been removed.

FIG. 1 through FIG. 3 show one embodiment of container 110 according to the invention. FIG. 1 is a side view of container 110 according to the invention. FIG. 2 is a side view of container 110 of FIG. 1 with container cap 360 in a second position for dispensing viscous comestibles 120. FIG. 3 is a side view of container 110 of FIG. 1 with container cap 360 removed to show details of container body 310. Container 110 in this embodiment includes container body 310, container body nozzle 150, and container cap 360. Container body 310 has proximal end 112 and a distal end 114. Container body nozzle 150 is at proximal end 112 of container body 310 and includes nozzle opening 330 through which viscous comestibles 120 are dispensed. Nozzle 150 in this embodiment includes straw 212, and straw base 214 as well as nozzle opening 330. Straw 212 is used to dispense viscous comestibles 120 from container 110. Straw cap 369 is used to seal nozzle opening 330.

Container 110 as shown in FIG. 1 through FIG. 3 includes container cap 360. Container cap 360 is movably coupled to container body 310 such that container cap 360 moves between at least two positions. Container cap 360 has a first position, shown in FIG. 1, where container cap 360 is towards proximal end 112. When container cap 360 is in the first position it covers nozzle 150 as shown. Nozzle 150 is covered, and access to nozzle 150 and nozzle opening 330 is blocked by container cap 360. This is the stored position of nozzle 150. In this way container cap 360 has a first position towards proximal end 112 where container cap 360 covers nozzle 150 in response to container cap 360 being in the first position.

Container cap 360 has a second position as shown in FIG. 2. FIG. 2 is a side view of container 110 with container cap 360 in the second position. Container cap 360 moves towards distal end 114 to place container cap 360 in the second position. Moving container cap 360 towards distal end 114 causes a portion of nozzle 150 to extend through container cap opening 358, exposing a portion of nozzle 150. In this embodiment container cap 360 moving to the second position exposes straw 212 of nozzle 150. Container cap 360 moves towards distal end 114, exposing straw 212 through container cap opening 358, until container cap 360 comes into contact with straw base 214 of nozzle 150. In some embodiments container cap opening 358 includes a tamper-proof seal, for example, but not by way of limitation, a perforated foil or plastic seal or ring which will be broken when container cap 360 is moved towards distal end 114 for the first time. Straw 212 is exposed by re-positioning attached container cap 360 towards distal end 114 of container 110. This re-positioning action moves container cap 360 along container body 310 of container 110 towards distal end 114 while simultaneously causing straw 212 to break through the tamper-proof perforated circle at container cap opening 358 of container cap 360, thus exposing straw 212 through container cap opening 358 of container cap 360. In some embodiments this re-positioning is accomplished by twisting container cap 360 along lip 115 (see FIG. 3) to move container cap 360 towards distal end 114. The twisting action can be a clockwise twisting action in some embodiments, or in other embodiments the twisting action can be counter-clockwise. In some embodiments actions other than a twisting action are used to re-position container cap 360 towards distal end 114 and expose a portion of nozzle 150. In this way a portion of nozzle 150 extends through container cap opening 358 in response to container cap 360 being in the second position. When container cap 360 is in the second position, straw 212 is exposed. Straw cap 369 can be removed from nozzle opening 330 and viscous comestibles 120 can be dispensed from container 110, such as by sucking on straw 212. In this way container cap 360 has a second position towards distal end 114 where straw 212 of nozzle 150 extends through container cap opening 358 in response to container cap 360 being in the second position.

Container cap 360 can be movably coupled to container body 310 in many different ways. In some embodiments container cap 360 can be removed from container body 310. In some embodiments container cap 360 cannot be removed from container body 310 once container cap 360 is coupled to container body 310 during assembly. FIG. 3 shows a side view of container 110 with container cap 360 removed, showing lip 115 which in this embodiment is used as a thread to move container cap 360 from the first position to the second position. Container cap 360 can be locked in the first position for storage and sale of container 110. When a consumer is ready to dispense viscous comestibles 120, container cap 360 can be rotated to engage lip 115, which will pull container cap 360 towards distal end 114, exposing straw 212 of nozzle 150.

Nozzle 150 can take many different shapes. In some embodiments nozzle 150 does not include straw 212. In some embodiments nozzle 150 does not include straw base 214. In the embodiment of container 110 shown in FIG. 1 through FIG. 3, nozzle 150 has straw 212 with a constant diameter for sucking viscous comestibles from container 110, and straw base 214 which tapers from the smaller diameter of straw 212 to the larger diameter of container body 310. The shape and taper angle of straw base 214 is optimized to make it easy to dispense frozen comestibles 120. Taper angle 154 of straw base 214 is designed to make it easy to suck viscous comestibles 120 into the mouth. Taper angle 154 in the embodiment of container 110 shown in FIG. 1 through FIG. 3 is about 50 degrees, but angles between about 20 degrees and about 60 degrees can be used for taper angle 154. The size and shape of straw 212 is designed for easy dispensing of viscous comestibles 120 from nozzle opening 330. In particular embodiments the size of straw 212 is between one-half inch and three-quarters of an inch in diameter. This diameter makes it easy to suck viscous comestibles 120, including chunky or thick mixtures, from container 110. The diameter of straw 212 according to the invention can vary from about one-quarter inch to about one and one-quarter inch in diameter. The shape of straw 212 is round in some embodiments. In some embodiments of container 110 the cross-sectional shape of straw 212 is oval. In some embodiments the cross-sectional shape of straw 212 is designed to closely fit the mouth.

Nozzle 150 and container body 310 are formed as a single piece in some embodiments, as shown in FIG. 3. Straw base 214 and straw 212 of nozzle 150 are integral to container body 310 in the embodiment shown in FIG. 1 through FIG. 3. In other embodiments nozzle 150 including straw 212 and straw base 214 can be manufactured as separate components from container body 310, and then later coupled to container body 310 during assembly of container 110. In some embodiments straw 212 is separate from straw base 214. In some embodiments straw base 214 is integral with container body 310, and straw 212 is a separate piece coupled to straw base 214. In some embodiments straw base 214 is flexible, allowing straw base 214 to fold into container body 310 in a retracted position for storage (see FIG. 4 through FIG. 6).

Distal end 114 of container 110 of FIG. 1 through FIG. 3 includes opening 335, plunger cap 320, and distal lip 122. Opening 335 is used to insert plunger cap 320 into container body 310. Plunger cap 320 retains viscous comestibles 120 within container body 310. Plunger cap 320 seals container body 310 at distal end 114 so that comestibles 120 do not exit container body 310 from distal opening 335. Plunger cap 320 fits frictionably within container body 310 so that plunger 320 can be moved from distal end 114 towards proximal end 112. In this way plunger cap 320 is sealably, frictionably fit within container body 310. When plunger cap 320 is moved from distal end 114 towards proximal end 112, viscous comestibles 120 are dispensed from nozzle opening 330 and can be consumed. Plunger 320 can be moved from distal end 114 towards proximal end 112 manually. When viscous comestibles 120 are dispensed from container 110 through nozzle opening 330 using suction, plunger cap 320 moves towards nozzle opening 330 as viscous comestibles 120 are dispensed (see FIG. 6 for an illustration of the movement of plunger cap 320 as viscous comestibles 120 are dispensed). This minimizes the amount of air that is allowed into container 110 as viscous comestibles 120 are dispensed. Plunger cap 320 utilizes plunger tip 325 to fit securely into straw base 214 and straw 212 allowing maximum consumption of viscous comestibles 120. As viscous comestibles 120 are sucked from container 110, plunger cap 320 will move towards nozzle 150 due to the frictional seal plunger cap 320 makes against container body 310. This makes it easier to suck viscous comestibles 120 from container 110 because air does not need to enter container 110 to replace the volume of viscous comestibles 120 extracted. This also keeps viscous comestibles 120 fresher and less contaminated because the amount of air that enters container 110 will be minimized and therefore contact between air and viscous comestibles 120 will be minimized.

Distal lip 122 is used to retain plunger cap 320 within container body 310. Plunger cap 320 can be initially inserted through distal opening 335 by mis-shaping it slightly. Once inserted, when container body 310 is filled with viscous comestibles 120, comestibles 120 will push plunger cap 320 towards distal opening 335 until plunger cap 320 encounters distal lip 122, at which point plunger cap 320 will stop moving towards distal opening 335 and container body 310 is full. Or alternatively, plunger cap 320 can be placed at distal opening 335 prior to filling container 110 with viscous comestibles 120, where again, distal lip 122 retains plunger cap 320 within container body 310 during the filling process.

Figure 4:
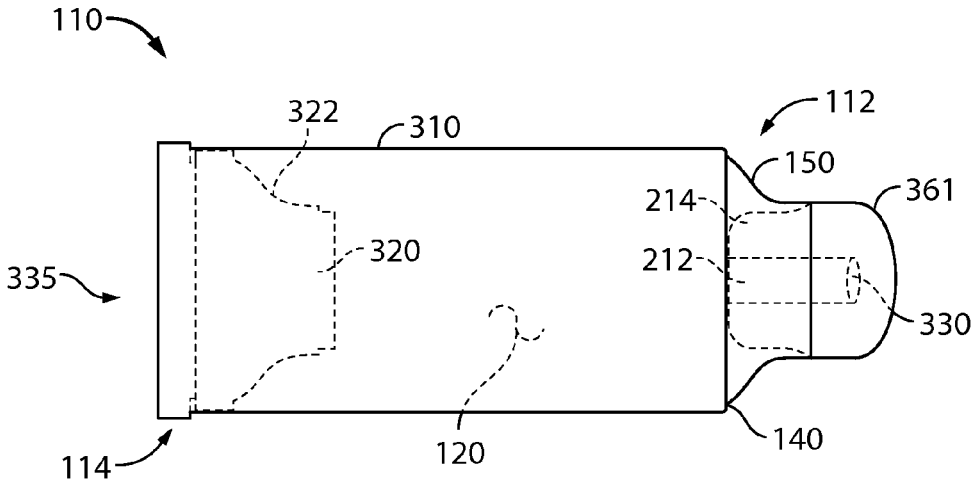
FIG. 4 is a side view of another embodiment of container 110 according to the invention, where nozzle 150 includes integral straw 212.
Figure 5:
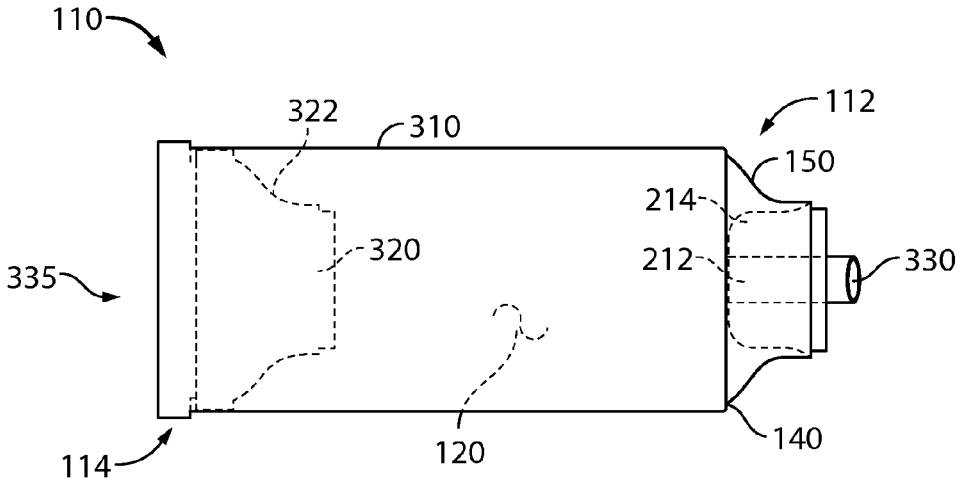
FIG. 5 is a side view of container 110 of FIG. 4 with lid 361 removed and straw 212 in the retracted position.
Figure 6:
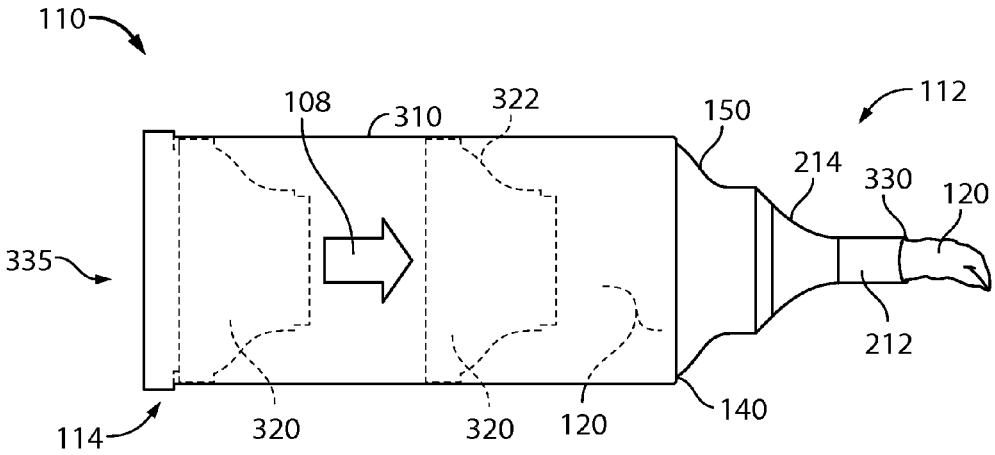
FIG. 6 shows container 110 of FIG. 5 with straw 212 in the extended position.

FIG. 4 through FIG. 6 show an additional embodiment of container 110 according to the invention, where container 110 includes container body 310 and container body nozzle 150. Nozzle 150 includes straw 212, straw base 214, and nozzle opening 330. In the embodiment of container 110 according to the invention shown in FIG. 4 through FIG. 6, lid 361 is used instead of container cap 360. It is to be understood that in some embodiments of container 110, container cap 360 as shown in FIG. 1 through FIG. 3 is used with container 110 shown in FIG. 4 through FIG. 6 instead of lid 361.

FIG. 4 is a side view of one embodiment of container 110 according to the invention. FIG. 5 is a side view of container 110 of FIG. 4 with lid 361 removed. FIG. 6 is a side view of container 110 of FIG. 4 with straw base 214 extended. In this embodiment of container 110, container body 310 includes proximal end 112 and distal end 114. Nozzle 150 is at proximal end 112 of container body 310. Nozzle 150 includes flexible straw base 214 coupled to container body 310 proximal end 112, and straw 212 coupled to flexible straw base 214 of nozzle 150. Nozzle opening 330 is at the proximal end of straw 212 for dispensing viscous comestibles 120. Nozzle 150 is made such that straw 212 has an extended position and a retracted position. The retracted position of straw 212 is shown in FIG. 4 and FIG. 5. The extended position of straw 212 is shown in FIG. 6. Straw base 214 in this embodiment is flexible so that straw 212 can be pushed into container body 310 by folding flexible straw base 214 into container body 310 as shown in FIG. 4 and FIG. 5. Straw 212 is in the retracted position when flexible straw base 214 is folded into container body 310. When straw 212 is in the retracted position, straw base 214 is folded into container body 310, and straw 212 is mostly contained within nozzle 150 and container body 310, as shown in FIG. 4 and FIG. 5. Lid 361 is coupled to nozzle 150 to cover nozzle opening 330 and retain straw 212 in the un-extended position. FIG. 4 shows container 110 according to the invention with straw 212 in the retracted position and lid 361 coupled to nozzle 150 to cover straw 212, straw base 214, and nozzle opening 330. Lid 361 prevents straw 212 from moving to the extended position when lid 361 is coupled to nozzle 150.

FIG. 5 shows a side view of container 110 of FIG. 4 with lid 361 removed. In this condition straw 212 is exposed and can be grasped with the fingers and pulled to place straw 212 in the extended position as shown in FIG. 6. FIG. 6 is a side view of container 110 of FIG. 4 with lid 361 removed and straw 212 in the extended position for dispensing viscous comestibles 120. Once straw base 214 is in the extended position as shown in FIG. 6, straw 212 can be used to suck out viscous comestibles 120 from container body 310 through nozzle opening 330. FIG. 6 also shows how plunger cap 320 moves through container body 310 from distal end 114 to proximal end 112 in direction 108 as viscous comestibles 120 are dispensed.

A feature of container 110 in some embodiments is that plunger interior surface contour 322 of plunger cap 320 mimics the interior surface contour of nozzle 150. Mimicking the surface contour means that the two surfaces have shapes that nest closely together. For instance, if the interior surface contour of nozzle 150 is shaped in general like a truncated cone and plunger cap 320 as the same cone—mimicking the nozzle 150 shape—with a rounder tip, when the two surfaces are moved together viscous comestibles 120 is pushed out nozzle opening 330 completely, with little left behind. This allows all of viscous comestibles 120 within container 110 to be dispensed. When plunger cap 320 is moved fully towards nozzle 150, the nozzle 150 interior surface contour and plunger interior surface contour 322 mate closely, with little to no space left between them for comestibles 120. As much as possible of viscous comestibles 120 is dispensed through nozzle opening 330, with little wasted comestibles 120 left behind in container 110.

Straw 212 of nozzle 150 provides an easy method for extracting viscous comestibles 120 from container 110. Most people are familiar with sucking edible contents through a straw and so this embodiment of container 110 will provide a familiar method to extract the contents. When integral straw 212 is attached to container body 310, straw 212 will not be lost or separated from container 110, and can be retracted within container body 310 for later use if the contents are not fully consumed right away. Flexible straw base 214 can allow multiple extensions and retractions of straw 212. In some embodiments straw 212 can be slidably attached to flexible straw base 214, allowing straw portion 212 to extend further into container body 310.

Straw 212 has a diameter large enough to allow easy suction of viscous or chunky viscous comestibles 120 from container 110. In a particular embodiment the size of straw 212 is from one-half inch to three-quarters of an inch in diameter. This is larger than the diameter of a typical straw. This provides a straw 212 diameter and nozzle opening 330 large enough to allow the higher viscosity frigid products to be efficiently extracted by suction out of container 110. The larger opening also allows easy extraction of lumped contents such as nuts, fruit, chunks, candy, granola, and similar contents included in viscous comestibles 120. In some embodiments straw 212 has a diameter in the range of one-quarter inch to one and one-quarter inch in diameter. Straw 212 may be round in cross-section or may have a shape such as an oval or other suitable shape designed to substantially match the contours of straw 212 to more closely fit the contours of the consumer's mouth for a better sealing action, especially that of young children.

Lid 361 is provided for enclosing nozzle opening 330 to substantially prevent spillage. Lid 361 may or may not be sealable to container 110 or nozzle 150, but may serve to provide an isolation means whereby contaminants are substantially prevented from entering nozzle opening 330. Lid 361 is repeatably couplable to nozzle 150 in some embodiments. In some embodiments lid 361 is screwed onto nozzle 150. In some embodiments lid 361 may be snapped onto nozzle 150. In the embodiment shown in FIG. 4 through FIG. 6, lid 361 is coupled to flexible straw base 214 of nozzle 150. In this embodiments lid 361 prevents straw 212 from moving to the extended position by preventing straw base 214 from unfolding from inside container body 310.

In some embodiments lid 361 is tamper-proof. Lid 361 being tamper-proof can be implemented in many different ways. A tamper-proof lid generally means one that has means whereby removing the lid or breaking the seal of the lid can be detected. For example, tamper-proof lid 361 can include a perforated seal that is broken when lid 361 is removed or repositioned, similar to sport drink bottles. Tamper-proof lid 361 can include a tamper-proof tab. Tamper-proof lid 361 can alternatively include a straw cap 369 (see FIG. 1) that covers nozzle opening 330. Once the seal is broken and straw 212 is exposed, the consumer can then remove straw cap 369 so comestibles 120 can safely be consumed. A tamper-proof lid 361 is used to enable the consumer to be able to detect if container 110 has been opened after initial sealing of container 110. Any of the methods mentioned and shown herein or other methods can be used to make lid 361 tamper-proof.

In some embodiments container cap 360 as shown in FIG. 1 through FIG. 3 is used with container 110 as shown in FIG. 4 through FIG. 6. In this embodiment container cap 360 would have two positions, one position towards proximal end 112, similar to what is shown in FIG. 1, where container cap 360 would cover nozzle 150. In the second position towards distal end 114, container cap 360 would expose straw 212 of nozzle 150, which could then be pulled into an extended position to dispense viscous comestibles 120.

In some embodiments container 110 includes dispensing ledge 140. Dispensing ledge 140 is used for an alternate method of dispensing viscous comestibles 120 from container 110 as will be discussed later in connection with FIG. 11.

Figure 7:
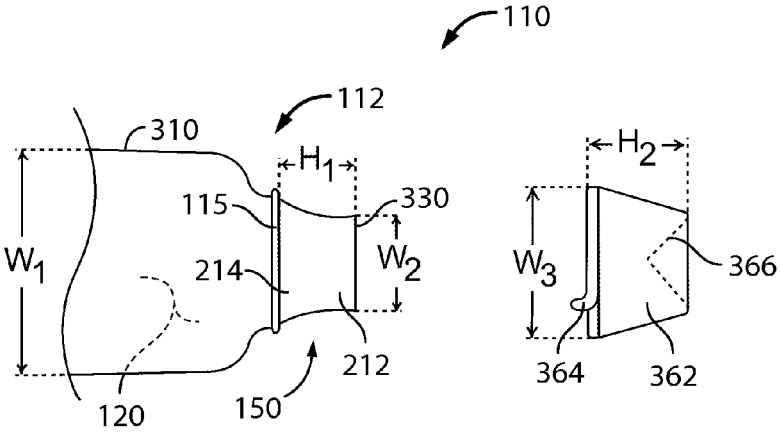
FIG. 7 is a side view of an additional embodiment of container 110 according to the invention, where container 110 includes lid 362.
Figure 8:
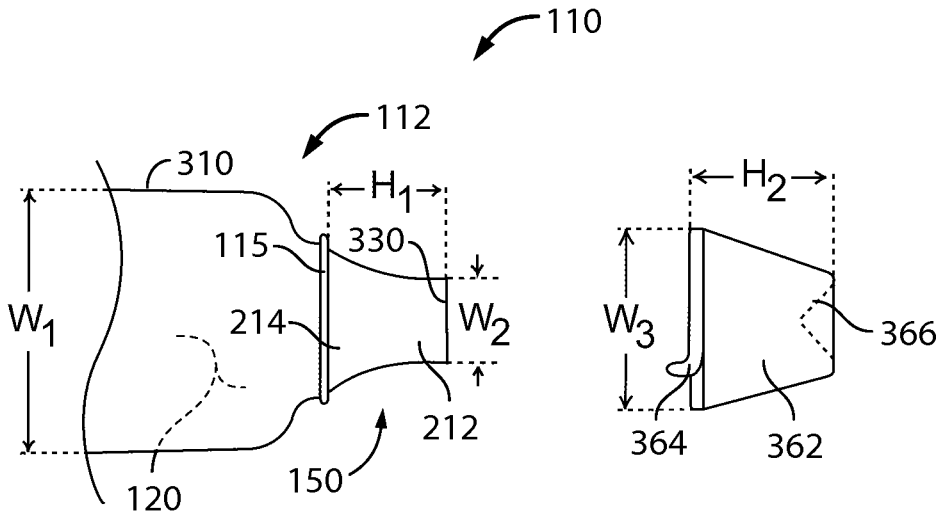
FIG. 8 shows a side view of a further embodiment of container 110 according to the invention, with container 110 including lid 362.
Figure 9:
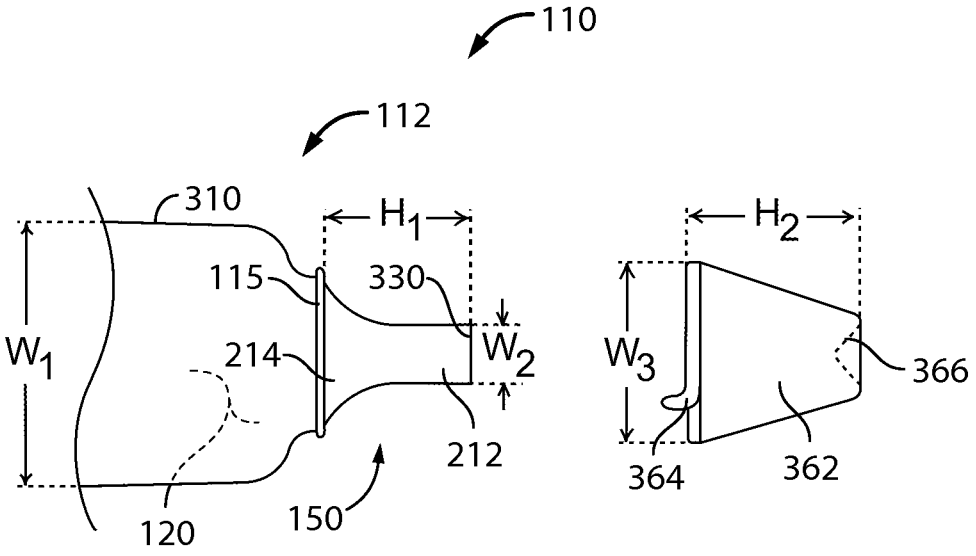
FIG. 9 shows a side view of another embodiment of container 110 according to the invention, where container 110 includes lid 362

FIG. 7 through FIG. 9 show additional embodiments of container 110 according to the invention, where container 110 includes lid 362. In the embodiments shown in FIG. 7 through FIG. 9, container 110 includes container body 310, and container body nozzle 150 at proximal end 112 of container body 310. Nozzle 150 includes straw 212, straw base 214, and nozzle opening 330. Lip 115 is used to retain lid 362 on container body 310. Lid 362 includes protrusion 366 and tamper-proof seal 364. Protrusion 366 fills nozzle opening 330 when lid 362 is attached to container body 310. Protrusion 366 helps to center lid 362 when lid 362 is being snapped onto lip 115 of container body 310. Protrusion 366 also helps keep nozzle opening 330 clear. Tamper-proof seal 364 provides an indication as to whether lid 362 has been removed from container body 310. Tamper-proof seal 364 helps seal lid 362 onto container body 310. Lid 362 cannot be removed from container body 310 without visibly modifying tamper-proof seal 364. Tamper-proof seal 364 can be removed by the user of container 110 at first use to make removal of lid 362 easier. FIG. 7 through FIG. 9 show how the height $H_1$ of nozzle 150 and the width $W_2$ of straw 212, and the height $H_2$ of lid 362 can be varied to provide different relative sizes of nozzle 150 and lid 362.

FIG. 7 shows a side view of an embodiment of container 110 where width $W_1$ of container body 310 is about 2.35 inches. Nozzle 150 height $H_1$ is about 0.75 inches, and straw 212 width $W_2$ is about 1.0 inches. Lid 362 width $W_3$ is about 1.5 inches and lid 362 height $H_2$ is about 0.825 inches. In this embodiment straw 212 of nozzle 150 is relatively wide and short, with a relatively wide nozzle opening 330. Lid 362 is relatively short to fit over nozzle 150. The embodiment shown in FIG. 7 is suited for lumped viscous comestibles 120 and for individuals which prefer a wider nozzle opening 330. This embodiment is also suitable for lower viscosity comestibles 120, which are less likely to spill from relatively wide nozzle opening 330.

FIG. 8 shows a side view of an embodiment of container 110 where width $W_1$ of container body 310 is about 2.35 inches. Nozzle 150 height $H_1$ is about 1.0 inches, and straw 212 width $W_2$ is about 0.75 inches. Lid 362 width $W_3$ is about 1.5 inches and lid 362 height $H_2$ is about 1.125 inches. In this embodiment straw 212 of nozzle 150 is longer and narrower than the embodiments shown in FIG. 7, with a medium nozzle opening 330. Lid 362 is longer to fit over nozzle 150.

FIG. 9 shows a side view of an embodiment of container 110 where width $W_1$ of container body 310 is about 2.35 inches. Nozzle 150 height $H_1$ is about 1.25 inches, and straw 212 width $W_2$ is about 0.50 inches. Lid 362 width $W_3$ is about 1.5 inches and lid 362 height $H_2$ is about 1.375 inches. In this embodiment straw 212 of nozzle 150 is longer and narrower than the embodiments shown in FIG. 7 and FIG. 8, with a relatively narrow nozzle opening 330. Lid 362 is longer to fit over nozzle 150. The embodiment shown in FIG. 9 is suitable for viscous comestibles 120 with no lumped contents or small lumps, and is suitable for use by individuals who prefer a relatively narrow straw 212. This embodiment is also suitable for higher viscosity comestibles 120.

In some embodiments of container 110 the specific values of $W_1$, $W_2$, $W_3$, $H_1$, and $H_2$ are different than those shown in FIG. 7 through FIG. 9. It should be understood that these values can be varied to suit the particular type of viscous comestibles 120 being dispensed and the target consumer.

Container 110 can comprise substantially unbreakable plastic. Or, in some embodiments, container 110 comprises paper material or other such suitable material or combination of materials. Plastic is preferred since it is durable, cost-efficient to manufacture and because it will not break if container 110 is dropped. In this manner, container 110 is effectively safe for use by children and adults in many conditions. Thus container 110 comprises a sanitary means to contain and dispense liquids and solids of various consistencies.

Container 110 may be a single use system or a multiple use system. In some embodiments lid 361 or lid 362 may be snapped back on to container body 310 to reseal container 110. In other embodiments, straw cover 369 may be used cover nozzle opening 330 and reseal container 110. After use, plunger cap 320 can be removed from container body 310 from distal opening 335 and both components cleaned for re-use or container 110 may be disposed of if used as a single-use system.

Figure 10:
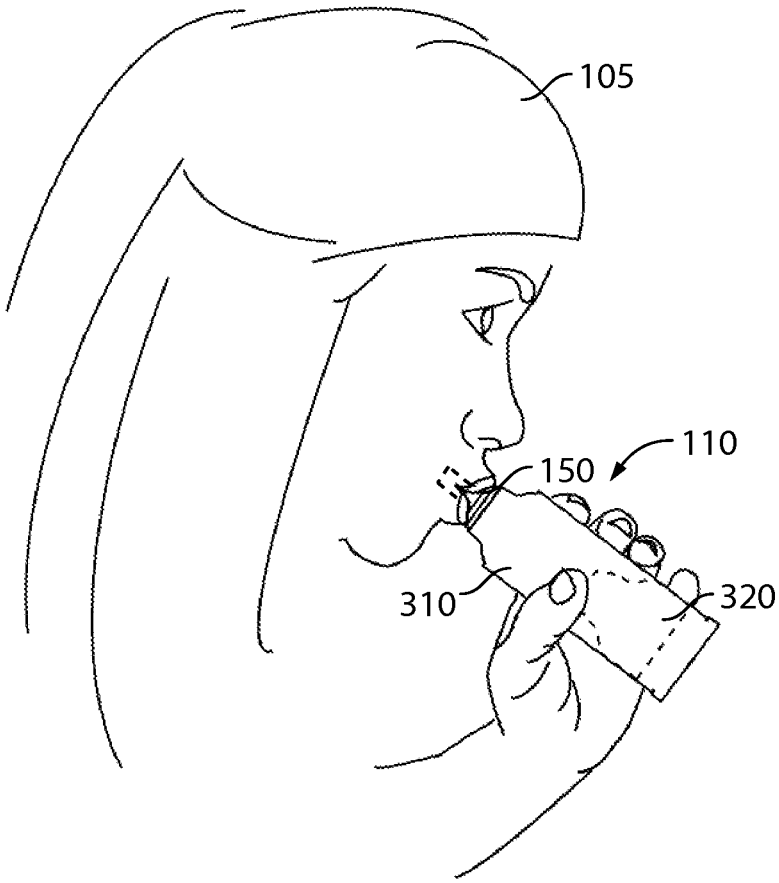
FIG. 10 shows a perspective view of one way to dispense viscous comestibles 120 from container 110.

FIG. 10 shows one method of dispensing viscous comestibles 120 from container 110 for consumption by consumer 105. Viscous comestibles 120 can be sucked from container 110 through nozzle opening 330 into the consumer's mouth. Nozzle opening 330 preferably comprises a substantially larger circumference than a conventional straw, thereby allowing the higher viscosity frigid products to be efficiently extracted by suction out of container 110. The larger opening also allows easy extraction of lumped contents such as nuts, fruit, chunks, candy, granola, and similar contents included in viscous comestibles 120. Nozzle 150 may be round or may additionally comprise at least one novel shape such as an oval or other suitable shape designed to substantially match the contours of nozzle 150 to more closely fit the contours of the consumer's mouth for a better sealing action, especially that of young children. The increased sealing effect substantially increases the suction force, thereby permitting higher viscosity products to be drawn up and consumed from container 110. Nozzle opening 330 typically has a larger diameter than a typical straw, but can still fit comfortably in the mouth of a consumer. Nozzle opening 330 can have a shape that is round in some embodiments, or nozzle opening 330 can be oval-shaped in some embodiments. In other embodiments nozzle opening 330 can have other shapes. Often nozzle opening 330 has an opening that is between one-quarter inch in diameter, which is 0.049 inch surface area and one and one-quarter inch in diameter, which is 1.23 inch surface area. This range is large enough to allow the more viscous product to be sucked from container 110 with minimal effort while being small enough to prevent spillage. This is because even at its largest diameter nozzle opening 330 has a smaller diameter than container body 310, as in the embodiments illustrated. This helps should container 110 tip on its side at a time when viscous comestibles 120 are less viscous. In this case viscous comestibles 120 will not spill due to the narrowing portion of nozzle 150.

Figure 11:
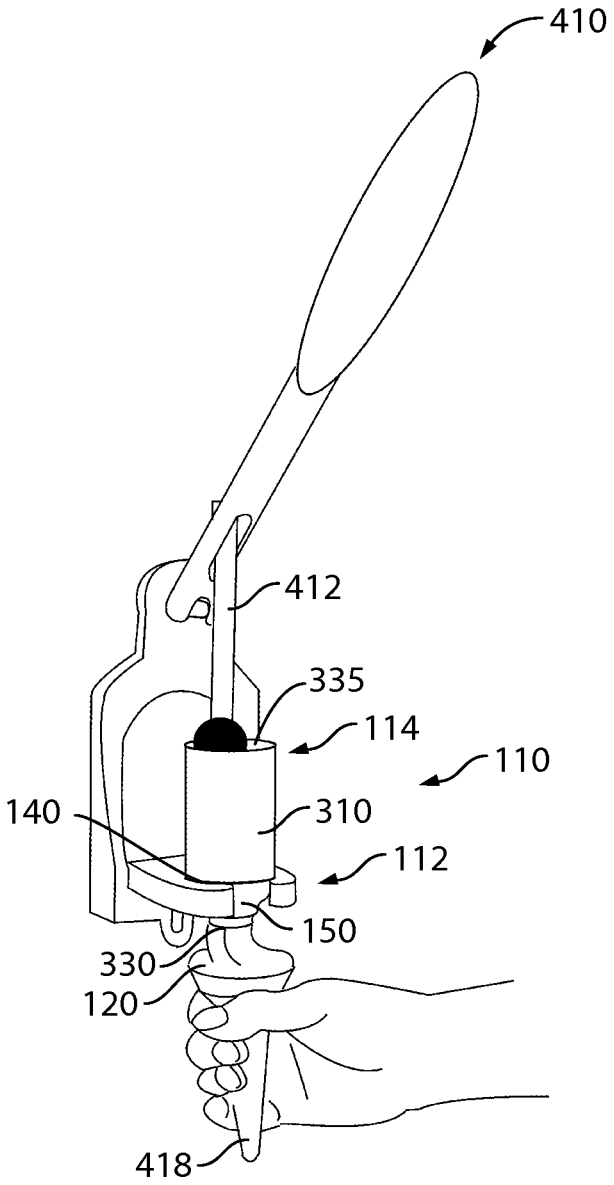
FIG. 11 shows a perspective view of another way to dispense viscous comestibles 120 from container 110.

FIG. 11 shows another way in which viscous comestibles 120 can be dispensed from container 110. This method uses press 410 and ledge 140 of container body 310. FIG. 11 shows a perspective view of the various components of press 410 being used to dispense viscous comestibles 120 from container 110. Dispensing ledge 140 serves to assist functionality of suction cup container 110 in the following ways: should a consumer desire a traditional soft serve, container 110 may be placed with proximal end 112 facing down on press 410, with container 110 resting on dispensing ledge 140. Viscous comestibles 120 are dispensed into cone 418 by pressing down on container body 310 distal end 114 with plunger 412. Dispensing ledge 140 preferably allows container 110 to have dual uses, firstly allowing it to be dispensed as a soft serve using press 410, or with nozzle 150 and straw 212, viscous comestibles 120 can be dispensed by suction means employed by the consumer. In some embodiments container 110 has multiple dispensing ledges. In some embodiments these ledges are different diameters to allow suction cup container 110 to be used with different types of presses.

Figure 12:
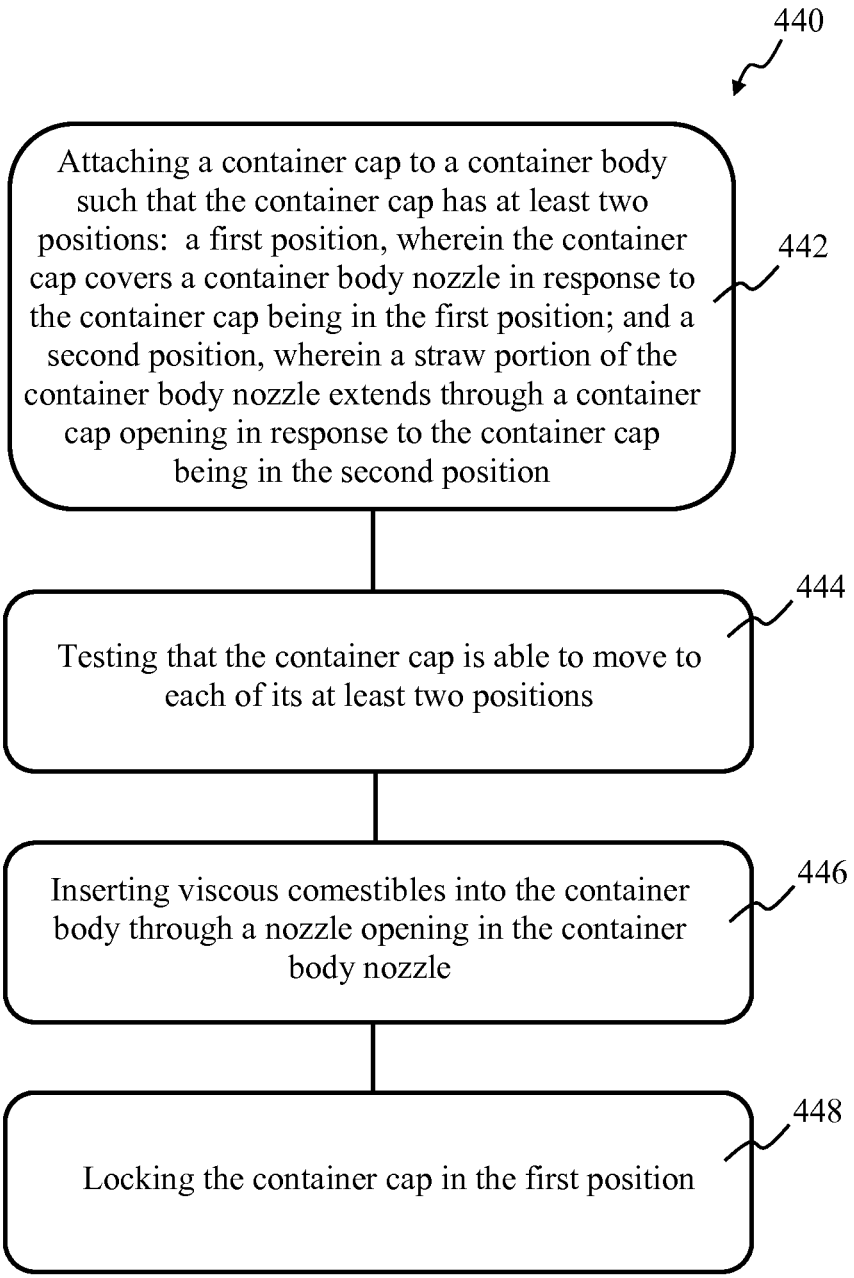
FIG. 12 shows a method for containing viscous comestibles according to the invention.

FIG. 12 illustrates a method 440 of containing viscous comestibles according to the invention, where method 440 includes several steps. Method 440 includes step 442 of attaching a container cap to a container body such that the container cap has at least two positions: a first position where the container cap covers a container body nozzle, and a second position where a straw portion of the container body nozzle extends through a container cap opening in the container cap. Method 440 also includes step 444, testing that the container cap is able to move to each of its at least two positions. Method 440 also includes step 446, inserting viscous comestibles into the container body through a nozzle opening in the container body nozzle. Method 440 also includes step 448, locking the container cap in the first position.

Method 440 can include many other steps. In some embodiments method 440 includes the step of sealing the container cap opening with a tamper-proof seal. Method 440 can also include the step of inserting a plunger cap into the distal end of the container body. In some embodiments method 440 includes the step of sealing the nozzle opening with a straw cap. Method 440 can also include the step of pulling the straw portion into an extended position.

A method of dispensing viscous comestibles according to the invention is also disclosed, the method comprising a step of selecting a flavor of viscous comestibles stored in a container, a step of exposing a straw by re-positioning a container cap, and a step of dispensing the viscous comestibles by utilizing the exposed straw. In some embodiments, the method of dispensing viscous comestibles can include many other steps, such as discarding the container once it is empty. In other embodiments the method of dispensing viscous comestibles can include cleaning the container for re-use.

A method of using a container of viscous comestibles is disclosed which includes the step of selecting a flavor of viscous comestibles stored in a container, the step of removing a lid from the container, and the step of extending a straw attached to the container body to dispense the viscous comestibles. The method of using a container of viscous comestibles can include many other steps.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A container for viscous comestibles comprising:
- a container body with a proximal end and a distal end;
- a nozzle at the proximal end, wherein the nozzle comprises a nozzle opening and a straw; and
- a container cap movably coupled to the container body, wherein the container cap has at least two positions:
  - a first position toward the proximal end, wherein the container cap covers the nozzle in response to the container cap being in the first position; and
  - a second position toward the distal end, wherein a portion of the nozzle extends through a container cap opening in response to the container cap being in the second position, wherein a portion of the nozzle extends
    - through a container cap opening in response to the container cap being in the second position and further wherein the distal end moves towards the proximal end in response to dispensing the viscous comestibles through the nozzle opening, wherein the straw has an extended position and a retracted position and wherein the straw comprises a flexible straw base, and further wherein the straw is in the retracted position in response to the flexible straw base folding into the container body.

2. The container of claim 1 wherein the container cap opening comprises a tamper-proof seal.

3. The container of claim 1 wherein the nozzle opening is covered with a straw cap.

4. The container of claim 1, wherein the straw is between one-half inch and three-quarters of one inch in diameter.

5. A container for viscous comestibles comprising:
- a container body with a proximal end and a distal end; and
- a nozzle at the proximal end, the nozzle comprising:
  - a flexible straw base coupled to the container body proximal end;
  - a straw coupled to the flexible straw base; and
  - a nozzle opening in the straw for dispensing the viscous comestibles, wherein the distal end moves towards the proximal end in response to dispensing the viscous comestibles through the nozzle opening, and further wherein the straw has a retracted position and an extended position and wherein the straw is in the retracted position in response to the flexible straw base folding into the container body.

6. The container of claim 5, further comprising a lid, wherein the lid prevents the straw from moving to the extended position in response to the lid being coupled to the nozzle.

7. The container of claim 5, further comprising a container cap movably coupled to the container body, wherein the container cap has at least two positions:
- a first position, wherein the container cap covers the nozzle in response to the container cap being in the first position; and a second position, wherein the straw extends through a container cap opening in response to the container cap being in the second position.

8. The container of claim 7, wherein the straw is between one-half inch and three-quarters of one inch in diameter.

9. The container of claim 8 wherein the straw is oval-shaped.

* * * * *